US005426455A

United States Patent [19]

Williamson et al.

[11] Patent Number: 5,426,455

[45] Date of Patent: Jun. 20, 1995

[54] THREE ELEMENT SWITCHED DIGITAL DRIVE SYSTEM FOR AN INK JET PRINTHEAD

[75] Inventors: Ralph K. Williamson; James L. Stortz, both of Spring, Tex.

[73] Assignee: Compaq Computer Corporation, Houston, Tex.

[21] Appl. No.: 60,298

[22] Filed: May 10, 1993

[51] Int. Cl.[6] ..... B41J 2/045

[52] U.S. Cl. ..... 347/10; 347/69; 310/317

[58] Field of Search ..... 346/1.1, 140 R; 310/316, 317; 347/9, 10, 11, 68-72; 307/239, 260, 270, 571

[56] References Cited

U.S. PATENT DOCUMENTS

| | | | |
|---|---|---|---|
| 3,857,049 | 12/1974 | Zoltan | 310/8.1 |
| 4,513,299 | 4/1985 | Lee et al. | 346/140 R |
| 4,523,200 | 6/1985 | Howkins | 346/1.1 |
| 4,523,201 | 6/1985 | Liker | 346/1.1 |
| 4,536,097 | 8/1985 | Nilsson | 400/126 |
| 4,584,590 | 4/1986 | Fischbeck et al. | 346/140 R |
| 4,675,693 | 6/1987 | Yano et al. | 346/1.1 |
| 4,717,927 | 1/1988 | Sato | 346/140 R |
| 4,743,924 | 5/1988 | Scardovi | 346/140 R |
| 4,752,790 | 6/1988 | Scardovi | 346/140 R |
| 4,825,227 | 4/1989 | Fischbeck et al. | 346/1.1 |
| 4,879,568 | 11/1989 | Bartky et al. | 346/140 R |
| 4,887,100 | 12/1989 | Michaelis et al. | 346/140 R |
| 4,931,810 | 6/1990 | Iwata et al. | 346/1.1 |
| 4,963,882 | 10/1990 | Hickman | 346/1.1 |
| 5,016,028 | 5/1991 | Temple | 346/140 R |
| 5,138,333 | 8/1992 | Bartky et al. | 346/1.1 |
| 5,227,813 | 7/1993 | Pies et al. | 346/140 R |
| 5,248,998 | 9/1993 | Ochiai et al. | 436/140 R |

FOREIGN PATENT DOCUMENTS

| | | | |
|---|---|---|---|
| 0364136 | 4/1990 | European Pat. Off. | B41J 2/045 |
| 0402172 | 12/1990 | European Pat. Off. | B41J 2/045 |
| 0485241 | 5/1992 | European Pat. Off. | B41J 2/045 |
| 0513971 | 11/1992 | European Pat. Off. . | |
| 3820082 | 12/1988 | Germany . | |
| 3924948 | 1/1991 | Germany . | |
| 3924957 | 1/1991 | Germany . | |
| 3924958 | 1/1991 | Germany . | |
| 3924960 | 1/1991 | Germany . | |
| 55-65568 | 5/1980 | Japan . | |
| 61-139120 | 6/1986 | Japan | 307/571 |

OTHER PUBLICATIONS

Wallace, David B., entitled "A Method of Characteristic Model of a Drop-on-Demand Ink-Jet Device Using an Integral Method Drop Formation Model", 89-WA/-FE-4 (1989).

Tsao, C. S., entitled "Drop-on-Demand Ink Jet Nozzle Array with Two Nozzles/Piezoelectric Crystal", *IBM Technical Disclosure Bulletin,* vol. 23, No. 10 (Mar. 1981).

*Primary Examiner*—Benjamin R. Fuller
*Assistant Examiner*—Alrick Bobb
*Attorney, Agent, or Firm*—Konneker & Bush

[57] ABSTRACT

A digital driver for an ink jet printhead and an associated method for selectively applying voltage to a piezoelectric sidewall actuator of the printhead. The digital driver includes positive, negative and neutral voltage sources, a first switching element having a first control input, a first voltage supply input connected to the positive voltage source and a first output, a second switching element having a second control input, a second voltage supply input connected to the negative voltage source and a second output, and a third switching element having a third control input, a third voltage supply input connected to the neutral voltage source and a third output. The first, second and third outputs are connected together to provide a common output for connection to the piezoelectric sidewall actuator. By asserting the first control input for a first time period, the first switching element generates a positive voltage pulse at the common output to displace the sidewall actuator from a rest position to a first position. Next, by simultaneously deasserting the first control input and asserting the second control input, the second switching element generates a negative voltage pulse at the common output to displace the sidewall actuator from the first position, past the rest position, to a second position. Finally, by deasserting the second control input and asserting the third control input, a path to ground potential is provided at the common output, thereby driving the return of the sidewall actuator to the rest position.

9 Claims, 2 Drawing Sheets

THREE ELEMENT SWITCHED DIGITAL DRIVE SYSTEM FOR AN INK JET PRINTHEAD

CROSS REFERENCE TO RELATED APPLICATIONS

This application is related to the following co-pending patent applications:

| Serial No. | First Named Inventor | Title |
|---|---|---|
| 08/060,440 | Stortz | Spot Size Modulatable Ink Jet Printhead |
| 08/060,295 | Stortz | Switched Digital Drive System For An Ink Jet Printhead |
| 08/060,296 | Stortz | Differential Drive System For An Ink Jet Printhead |
| 08/060,294 | Wallace | Droplet Volume Modulation Techniques For Ink Jet Printheads |
| 08/060,297 | Stortz | Dual Element Switched Digital Drive System For An Ink Jet Printhead |

All of the above listed applications were filed on even date herewith, assigned to the Assignee of the present invention, and hereby incorporated by reference as if reproduced in its entirety.

BACKGROUND OF THE INVENTION

1. Field of the Invention

The present invention generally relates to ink jet printhead apparatus and, more particularly, to a three element switched digital drive system for piezoelectrically driving an ink jet printhead.

2. Description of Related Art

A piezoelectrically actuated ink jet printhead is a relatively small device used to selectively eject tiny ink droplets onto a paper sheet operatively fed through a printer, in which the printhead is incorporated, to thereby form from the ejected ink droplets selected text and/or graphics on the sheet. In one representative configuration thereof, an ink jet printhead has a horizontally spaced parallel array of internal ink-receiving channels. These internal channels are covered at their front ends by a plate member through which a spaced series of small ink discharge orifices are formed. Each channel opens outwardly through a different one of the spaced orifices.

A spaced series of internal piezoelectric wall portions of the printhead body separate and laterally bound the channels along their lengths. To eject an ink droplet through a selected one of the discharge orifices, the two printhead sidewall portions that laterally bound the channel associated with the selected orifice are first piezoelectrically outwardly deflected away from the channel to impart an expansive into the channel. The sidewall portions are held in the outwardly deflected position while the rearwardly propagating portion of the expansive pressure pulse reflects off a back wall of the channel and begins to propagate forwardly in the channel. When the forwardly propagating reflected wave returns to its point of origination, the sidewall portions are inwardly deflected past the rest position and into the channel and again held, thereby imparting a second, reinforcing, pressure pulse into the channel. The sidewall portions are then returned to their normal, undeflected positions. This driven inward deflection of the opposite channel wall portions increases the pressure of the ink within the channel sufficiently to initiate the ejection of a small quantity of ink, in droplet form, outwardly through the discharge orifice.

According to a recently proposed drive method for this type of ink jet printhead, top sides of the internal channel dividing wall portions are commonly connected to ground, and the bottom sides of the wall portions are individually connected to a series of electrical actuating leads. Each of these leads, in turn, is connected to a drive system operable to selectively impart to the lead an electrical waveform that sequentially changes (1) from ground to a first driving polarity, (2) from the first polarity to the opposite polarity, and (3) from the opposite polarity back to ground.

When this electrical waveform is imparted to a piezoelectric channel wall portion bounding one side of a selected, and a second electrical waveform of opposite polarity sequence is simultaneously imparted (via another one of the actuating leads) to the opposite piezoelectric channel wall portion, the opposite channel wall portions, by piezoelectrical action, are sequentially deflected (1) outwardly away from the channel that they laterally bound, (2) into the channel to initiate the ejection of an ink droplet therefrom, and (3) back to their starting or "neutral" positions.

To provide the above drive method in an ink jet printhead, the use of an analog type drive system in which analog circuitry, for example, operational amplifiers (or "op-amps"), deliver the desired driving voltages to the sidewall portions of the ink jet printhead has been suggested. To do so, the analog type drive system would generate an analog voltage waveform which moves linearly from 0 volts to a positive peak +V volts. After holding the voltage at the positive peak for a first period of time, the analog drive system would then move linearly to a negative peak of −V volts and, after again holding the voltage at the negative peak for a second period of time, move linearly back to 0 volts. Due to their linear nature, such analog type drive systems tend to produce unacceptably high levels of power dissipation and have, therefore, proven inefficient in use. Furthermore, when utilized as the drive system for an ink jet printhead, such analog type drive systems tend to lower the operating speed of the printhead. Finally, such analog type drive systems require excessive space on the printhead, thereby adversely affecting driver density for the printhead.

It can be readily seen from the foregoing that it would be desirable to provide an improved ink jet printhead drive system that eliminates, or at least substantially reduces, the above-mentioned limitations and disadvantages associated with the drive systems described above. It is accordingly an object of the present invention to provide such an improved ink jet printhead drive system.

SUMMARY OF THE INVENTION

In various embodiments thereof, the present invention is of a digital driver for selectively applying voltage to a piezoelectric sidewall actuator to cause the selective deflection of the actuator to impart pressure pulses into first and second channels of an ink jet printhead and an ink jet printhead incorporating the same. The digital driver includes a first switching element having a first control input, a first voltage supply input for connection to a positive voltage source and a first output, a second switching element having a second control input, a second voltage supply input for connection to a negative voltage source and a second output, and a third switching element having a third control input, a third voltage supply input for connection to a neutral voltage source and a third output. The first, second and third outputs are connected together to provide a single output for connection to a piezoelectric sidewall actuator of an ink jet printhead.

In response to an assertion of the first control input, the first switching element generates a positive voltage pulse at the single output to operatively drive the piezoelectric sidewall actuator from a rest position to a first deflected position. Likewise, in response to an assertion of the second control input, the second switching element generates a negative voltage pulse at the single output to operatively drive the piezoelectric sidewall actuator from the first position, past the rest position, and to a second position. Finally, in response to an assertion of the third control input, the third switching element returns the single output to ground potential, thereby operatively driving the piezoelectric sidewall actuator from the second position back to the rest position.

In further embodiments thereof, the present invention is of a digital driver, and associated methods, for selectively applying voltage to a piezoelectric sidewall actuator to cause the selective deflection of the actuator to impart pressure pulses into first and second channels of an ink jet printhead. The digital driver includes a positive voltage source, a negative voltage source, a neutral voltage source, a first switching element having a first control input, a first voltage supply input connected to the positive voltage source and-a first output, a second switching element having a second control input, a second voltage supply input connected to the negative voltage source and a second output, and a third switching element having a third control input, a third voltage supply input connected to the neutral voltage source and a third output. The first, second and third outputs are connected together to provide a single output for connection to a piezoelectric sidewall actuator of an ink jet printhead.

By asserting the first control input, the first switching element generates a positive voltage pulse at the single output to displace, in a first direction, the sidewall actuator from a rest position to a first position. Next, by simultaneously deasserting the first control input and asserting the second control input, the second switching element generates a negative voltage pulse at the single output to displace, in a second direction, the sidewall actuator from the first position, past the rest position, to a second position. Finally, by simultaneously deasserting the second control input and asserting the third control input, the third switching element returns the output to ground potential to drive the return of the sidewall actuator from the second position to the rest position.

The switched digital drive system of the invention provides several advantages over prior analog type printhead drive systems in that the digital drive system is considerably less complex and is thus less expensive. Moreover, the digital drive system requires appreciably less space, thereby permitting driver density, i.e., the number of drivers which may be provided in a unit of area, to be increased. Finally, by eliminating the linearity of the voltage transitions between the rest, positive peak and negative peak voltages, the operating speed of the ink jet printhead may be increased.

DETAILED DESCRIPTION

Figure 1:
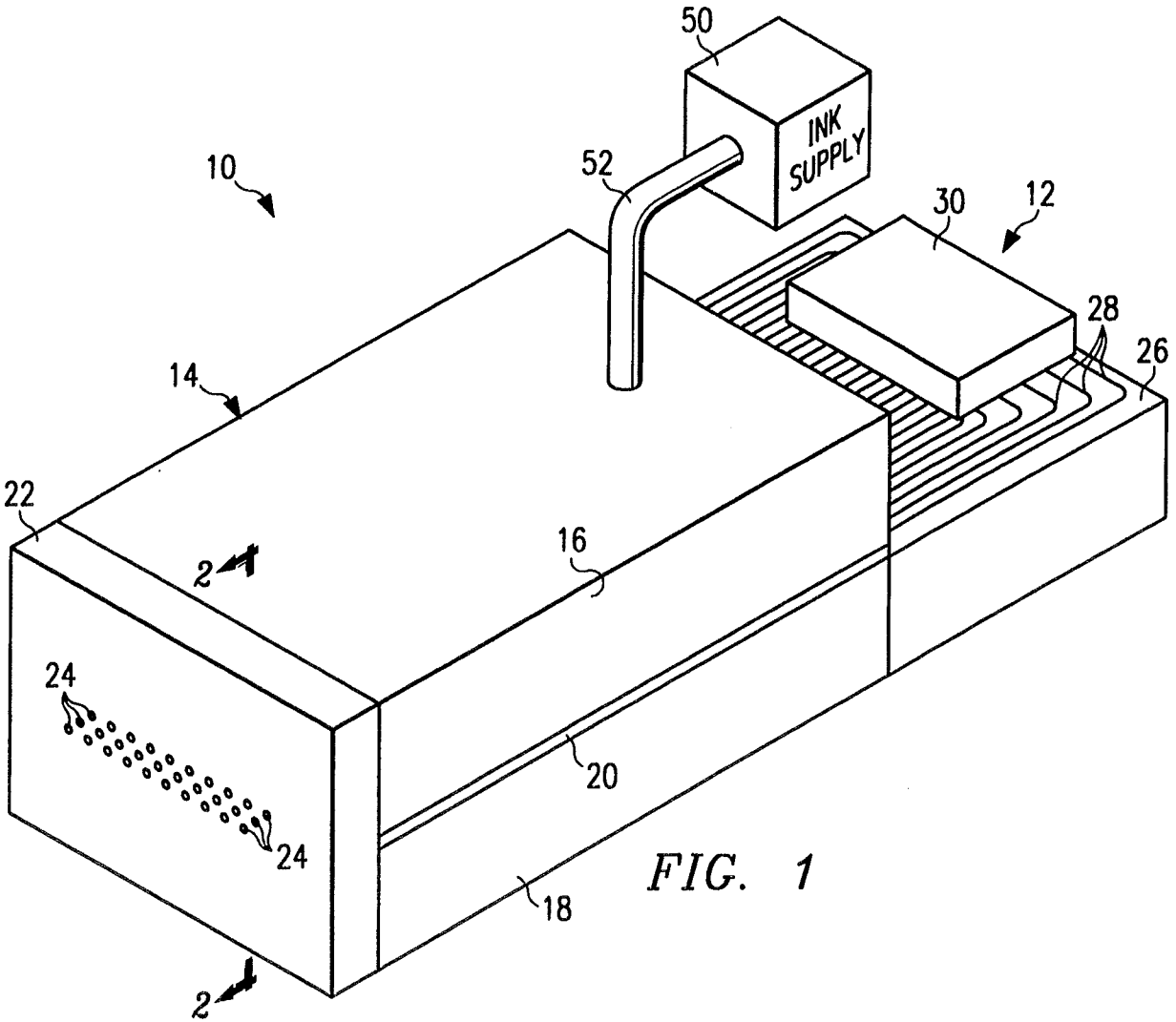
FIG. 1 is a simplified, somewhat schematic perspective view of an ink jet printhead incorporating therein a specially designed three element switched digital drive system constructed in accordance with the teachings of the present invention.
Figure 2:
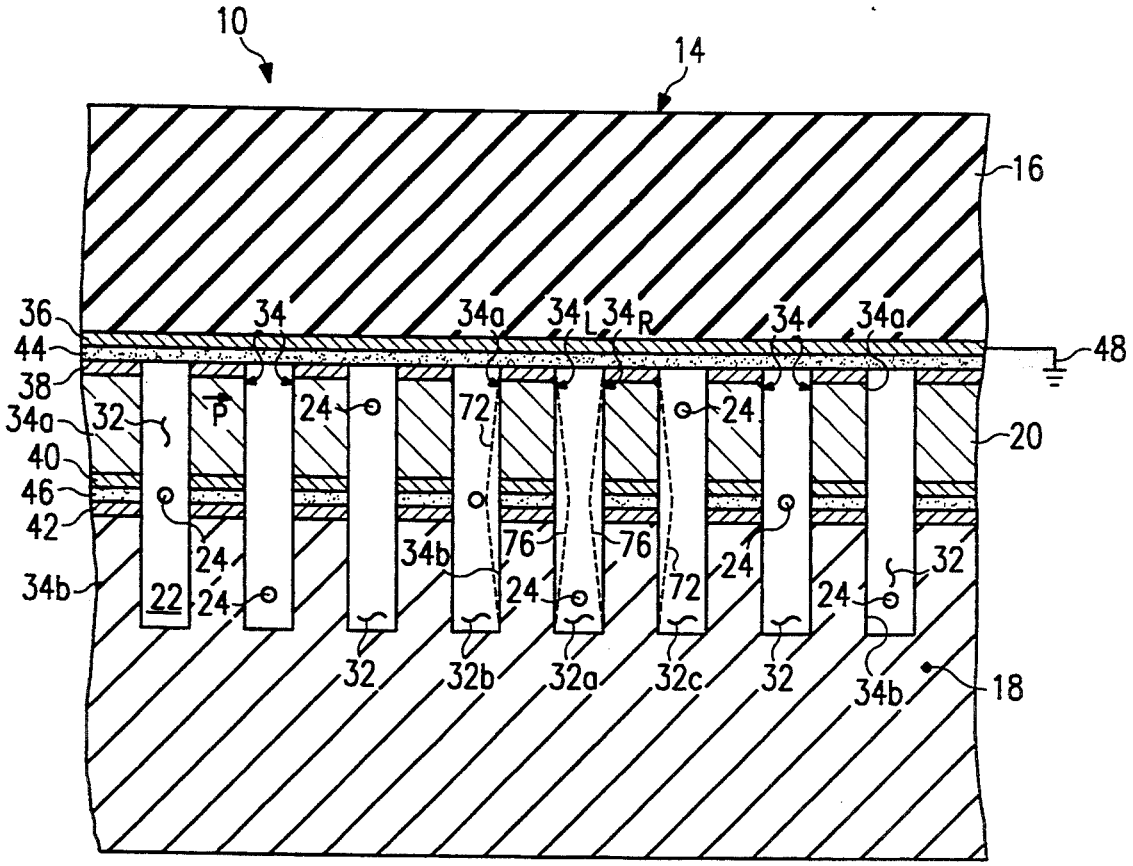
FIG. 2 is an enlarged scale partial cross-sectional view through the printhead taken along line 2—2 of FIG. 1.

Referring now to the drawing where like reference numerals designate the same or similar elements throughout the several views, in FIGS. 1 and 2, an ink jet printhead 10 incorporating therein a specially designed three element switched digital drive system 12 constructed in accordance with the teachings of the present invention may now be seen. The ink jet printhead 10 has a body 14 having upper and lower rectangular portions 16 and 18, with an intermediate rectangular body portion 20 secured between the upper and lower portions 16 and 18 in the indicated aligned relationship therewith. A front end section of the body 14 is defined by an orifice plate member 22 having a spaced series of small ink discharge orifices 24 extending rearwardly therethrough. As shown, the orifices 24 are arranged in horizontally sloped rows of three orifices each.

In a left-to-right direction as viewed in FIG. 1, the printhead body portions 16,20 are shorter than the body portion 18, thereby leaving a top rear surface portion 26 of the lower printhead body portion 18 exposed. For purposes later described, a spaced series of electrical actuation leads 28 are suitably formed on the exposed surface 26 and extend between the underside of the intermediate body portion 20 and a controller portion 30 of the three element switched digital drive system 12 mounted on the surface 26 near the rear end of the body portion 18.

Referring now to FIG. 2, a plurality of vertical grooves of predetermined width and depth are formed in the printhead body portions 18 and 20 to define within the printhead body 14 a spaced, parallel series of internal ink receiving channels 32 that longitudinally extend rearwardly from the orifice plate 22 (see FIG. 1) and open at their front ends outwardly through the orifices 24. The channels 32 are laterally bounded along their lengths by opposed pairs of a series of internal actuation sidewall sections 34 of the printhead body. Sidewall sections 34 have upper parts **34*a* defined by horizontally separated vertical sections of the body portion 20, and lower parts 34*b* defined by horizontally separated sections of the body portion 18. The underside of the body portion 16, the top and bottom sides of the actuation sidewall section parts 34*a*, and the top sides of the actuation sidewall section parts 34*b* are respectively coated with electrically conductive metal layers 36, 38,40 and 42**.

Body portions 16 and 20 are secured to one another by a layer of electrically conductive adhesive material 44 positioned between the metal layers 36 and 38, and the upper and lower actuator parts 34*a* and 34*b* are intersecured by layers of electrically conductive material 46 positioned between the metal layers 40 and 42. The metal layer 36 on the underside of the upper printhead body portion 16 is connected to ground 48. Accordingly, the top sides of the upper actuator parts 34*a* are electrically coupled to one another and to ground 48 via the metal layers 38, the conductive adhesive layer 44 and the metal layer 36.

Each of the channels 32 is filled with ink received from a suitable ink supply reservoir 50 (see FIG. 1) connected to the channels via an ink delivery conduit 52 connected to an ink supply manifold (not shown) disposed within the printhead body 14 and coupled to rear end portions of the internal channels 32. In a manner subsequently described, each horizontally opposed pair of the sidewall actuators 34 is piezoelectrically deflectable into and out of their associated channel 32, under the control of the three element switched digital drive system 12, to initiate the ejection of ink (in droplet form) outwardly through the orifice 24 associated with the actuated channel.

Figure 3:
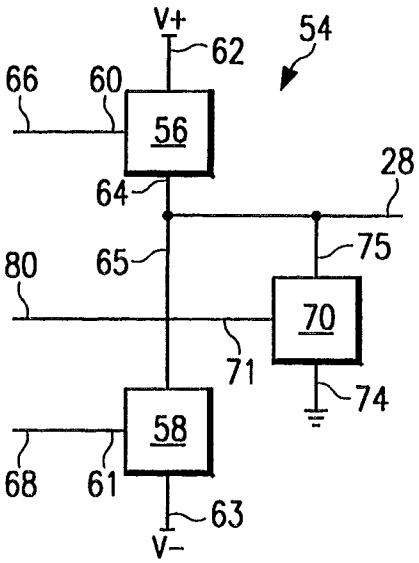
FIG. 3 is a schematic wiring diagram of a three element switched digital drive system incorporated into the ink jet printhead of FIG. 1.

Referring now to FIGS. 1 and 3, as previously mentioned, the three element switched digital drive system 12 includes the controller 30 which is operatively connected to rear ends of the electrical actuation leads 28. The front ends of the leads 28 are individually connected to the metal layers 42 (see FIG. 2) on the undersides of the top sidewall actuator parts 34*a*. Within the controller 30 are a series of switching structures 54 each of which is connected to one of the leads 28 as schematically depicted in FIG. 3.

Each switching structure 54 includes first, second and third switching elements 56, 58 and 70. It is contemplated that various switching circuits, for example, a bipolar transistor or a field effect transistor, are suitable for use as the switching elements 56, 58 70. The first switching element 56 has a control input line 60 connected to a first (or "drive_pos") drive signal 66, a supply voltage input line 62 connected to a positive DC voltage source and an output line 64 connected to lead 28. Similarly, the second switching element 58 has a control input line 61 connected to a second (or "drive_neg") drive signal 68, a supply voltage input line 63 connected to a negative DC voltage source and an output line 65 connected to lead 28. Finally, the third switching element 70 has a control input line 71 connected to a third (or "drive_gnd") drive signal 80, an input line 74 connected to ground and an output line 75 connected to lead 28.

In operation, the first drive signal 66 is asserted during a first time interval to produce a positive pulse as the output at lead 28 which would drive a piezoelectric sidewall actuator 34 electrically associated therewith, from a rest position, in a first direction, thereby imparting a compressive pressure pulse to a first ink-carrying channel 32 partially defined by the sidewall actuator 34 being driven by the switching structure 54 and an expansive pressure pulse to a second ink-carrying channel 32 partially defined by the sidewall actuator 34 being driven by the switching structure 54.

Next, during a second time interval, the first drive signal 66 is deasserted and the second drive signal 68 is simultaneously asserted, thereby causing the output at lead 28 to transition from positive to negative, thereby driving the piezoelectrical sidewall actuator 34 electrically associated therewith in the opposite direction, thereby imparting a compressive pressure pulse to the second ink-carrying channel 32 partially defined by the sidewall actuator 34 being driven by the switching structure 54 and an expansive pressure pulse to the first ink-carrying channel 32 partially defined by the sidewall actuator 34 being driven by the switching structure 54.

Finally, during a third time interval, the third drive signal 80 is asserted and the second drive signal 68 is simultaneously deasserted while the first drive signal 66 remains deasserted. In response thereto, the output at lead 28 of the switching structure 54 returns to ground potential, thereby driving the sidewall actuator 34 driven by the switching structure 54 back to its rest position.

With respect to each of the first, second and third switching elements 56, 58 and 70, the controller 30 is operative to selectively transmit the drive_pos control signal 66 to the control input 60 of the switching element 56, the drive_neg control signal 68 to the control input 61 of the second switching element 58 and the drive_gnd control signal 80 to the control input 71 of the third switching element 70. Receipt of the drive_pos control signal 66 by the switching structure 54 creates a positive DC voltage in its associated electrical actuation lead 28, while receipt of the drive_neg control signal 68 by the switching structure 54 creates a negative DC voltage in the lead 28. Receipt of the drive_gnd control signal 70, on the other hand, actively drives the voltage in the lead 28 to ground. Via the lead 28, this positive, negative or grounded DC voltage is transmitted to the upper actuation sidewall portion metal layer 42 to which the lead 28 is operatively connected.

Using the three element switched digital drive system 12 of the present invention a selected one or more of the ink receiving channels 32 may be actuated to drive a quantity of ink therein, in droplet form, outwardly through the associated ink discharge orifice(s) 24.

Figure 4:
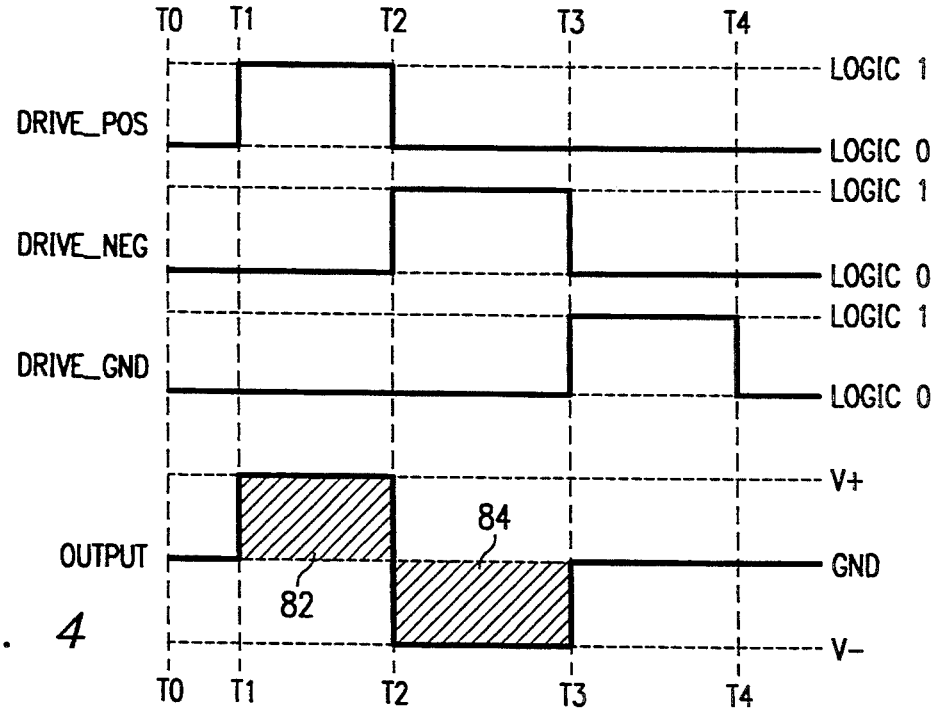
FIG. 4 is a timing diagram illustrating a representative actuation sequence of one of the three switching elements of the digital drive system of FIG. 3.

To illustrate the operation of the three element switched digital drive system 12 incorporating a switching circuit 54 such as that illustrated in FIG. 3, the actuation of a representative channel 32a of the ink jet printhead 14 will now be described in conjunction with FIGS. 2 and 4. Prior to the actuation of the channel 32*a*, its horizontally opposed left and right sidewall actuators $34_L$ and $34_R$ are (at time $T_o$ in FIG. 4) in initial, laterally undeflected (or "rest") positions indicated by solid lines in FIG. 2. To initiate the channel actuation cycle, the switching structure 54 associated with the left sidewall actuator $34_L$ is operated to impose thereon a constant positive DC voltage pulse 82 during the time interval $T_1$–$T_2$ shown in FIG. 4. Simultaneously, the switching structure 54 associated with the right sidewall actuator $34_R$ is operated to impose thereon an equal constant negative DC voltage pulse during the time interval $T_1$–$T_2$. These opposite polarity DC voltage pulses transmitted to the sidewall actuators $34_L$ and $34_R$ outwardly deflect them away from the channel 32*a* being actuated and into the outwardly adjacent channels 32*b* and 32*c* as indicated by the dotted lines 72 in FIG. 2, thereby imparting respective compressive pressure pulses to the channels 32*b* and 32*c* and expansive pressure pulses to the channel 32*a*.

To cause the sidewall actuator $34_L$ to deflect in this manner, at time $T_1$, the drive_pos control input 66 is asserted, thereby causing the first switching element 56 of the switching structure 54 to generate a positive voltage pulse 82 at the output line 64. The positive voltage pulse 82 is then transmitted from the output line 64 to the sidewall actuator $34_L$ via lead 28.

Next, at time $T_2$, the positive voltage pulse 82 transmitted to sidewall actuator $34_L$ and the corresponding negative voltage pulse on the sidewall actuator $34_R$ are terminated, and the two switching structures 54 are operated to simultaneously impose a constant negative DC voltage pulse 84 on the left sidewall actuator $34_L$, while imposing an equal constant positive DC voltage pulse on actuator $34_R$, during the time interval $T_2$–$T_3$. These opposite polarity constant DC voltage pulses inwardly deflect the sidewall actuators $34_L$ and $34_R$ past their initial undeflected positions and into the channel 32*a* as indicated by the dotted lines 76 in FIG. 2, thereby simultaneously imparting respective compressive pressure pulses into the channel 32*a*. Such inward deflection of the actuators $34_L$ and $34_R$ reduces the volume of channel 32*a*, thereby elevating the pressure of ink therein to an extent sufficient to initiate the ejection of a quantity of the ink, in droplet form, outwardly through the orifice 24 associated with the actuated channel 32*a*.

To cause the sidewall actuator $34_L$ to deflect in this manner, at time $T_2$, the drive_pos control input 66 is deasserted and the drive_neg control input 68 is asserted, thereby causing the first switching element 56 of the switching structure 54 to terminate the positive voltage pulse 82 and causing the second switching element 58 of the switching structure 54 to generate the negative voltage pulse 84 at the output line 65. The negative voltage pulse 84 is then transmitted from the output line 65 to the sidewall actuator $34_L$ via the lead 28.

Next, at time $T_3$, the negative voltage pulse 74 applied to sidewall actuator $34_L$ and the corresponding positive voltage pulse applied to the sidewall actuator $34_R$ are terminated, and the switching structures 54 are operated to cause the voltage applied to the sidewall actuators $34_L$ and $34_R$ by their respective leads 28 to return to ground, thereby driving the sidewall actuators $34_L$ and $34_R$ back to their respective rest positions.

To drive the sidewall actuators $34_L$ back to its rest position, at time $T_3$, the drive_neg control input 68 is deasserted and the drive_gnd control input 80 is simultaneously asserted while the drive_pos control input 66 remains deasserted. Upon assertion of the drive_gnd control input 80, the third switching element 70 interconnects the neutral supply voltage and the output line 75. This interconnection provides a path to ground potential for the output 28, thereby discharging the negative voltage pulse 84 applied across the sidewall actuator $34_L$ and driving the sidewall actuators $34_L$ back to the rest position at time $T_3$. The drive_gnd control input 80 remains asserted while the drive_pos and drive_neg control inputs 66 and 68 remain deasserted to hold the sidewall actuators $34_L$ and $34_R$ in the rest position during the time interval $T_3$–$T_4$. This provides a short rest period during which the pressure waves propagating throughout the channel $32_a$ to subside before a next channel actuation cycle is initiated.

Compared to analog drive systems used to actuate selectively variable internal ink receiving channels in an ink jet printhead, the three element switched digital drive system 12 of the present invention provides several desirable advantages. First the overall space requirement for the disclosed digital drive system would be less than the space demanded by an analog drive system performing the same functions. This permits an increase in driver density and a corresponding reduction in cost for the ink jet printhead. Additionally, by eliminating linear transitions between voltage states for each switching structure of the digital driver, the driver is able to complete switches between voltage states faster than analog drive systems, thereby speeding the frequency at which the sidewall actuators may be displaced to fire the channels of the ink jet printhead. Thus, an ink jet printhead controlled by a digital drive system would be able to operate at higher speeds.

The foregoing detailed description is to be clearly understood as being given by way of illustration and example only, the spirit and scope of the present invention being limited solely by the appended claims.

What is claimed is:

1. A method of operatively driving a piezoelectric sidewall actuator of an ink jet printhead, comprising the steps of:

providing a switching structure having a first, a second and a third control input and an output connected to said sidewall actuator, each of said a first, a second and a third control input being initially deasserted;

asserting said first control input while said second and said third control input remain deasserted, said switching structure providing a positive voltage at said output in response thereto, said positive output voltage driving said sidewall actuator from a rest position to a first position;

simultaneously deasserting said first control input and asserting said second control input while said third control input remains deasserted, said switching structure providing a negative voltage at said output in response thereto, said negative output voltage driving said sidewall actuator from said first position, past said rest position, and to a second position; and simultaneously deasserting said second control input and asserting said third control input while said first control input remains deasserted, said switching structure providing a path to ground potential at said output in response thereto, said path to ground potential at said output driving said sidewall actuator from said second position to said rest position.

2. A method of operatively driving a piezoelectric sidewall actuator of an ink jet printhead according to claim 1 and further comprising the step of deasserting said third control input after said sidewall actuator returns to said rest position.

3. A digital driver for selectively applying voltage to a piezoelectric sidewall actuator bounding a first channel and a second channel of an ink jet printhead to cause a selective deflection of said actuator to impart pressure pulses into said first channel and said second channel of said ink jet printhead, comprising:

a first switching element having a first control input, a first voltage supply input for connection to a positive voltage source and a first output;

a second switching element having a second control input, a second voltage supply input for connection to a negative voltage source and a second output;

a third switching element having a third control input, a third voltage supply input for connection to a neutral supply voltage and a third output;

said first, said second and said third output connected to provide a single output for connection to said piezoelectric sidewall actuator of said ink jet printhead;

said first switching element further comprising means for generating a positive voltage pulse at said single output in response to an assertion of said first control input while said second control input and said third control input are deasserted;

said second switching element further comprising means for generating a negative voltage pulse at said single output in response to a simultaneous deassertion of said first control input and assertion of said second control input while said third control input is deasserted; and said third switching element further comprising means for providing a path to ground potential at said single output in response to a simultaneous deassertion of said second control input and assertion of said third control input while said first control input is deasserted.

4. A digital driver for selectively applying voltage to a piezoelectric sidewall actuator bounding a first channel and a second channel of an ink jet printhead to cause a selective deflection of said actuator to impart pressure pulses into said first channel and said second channel of said ink jet printhead, comprising:

a positive voltage source;

a first switching element having a first control input, a first voltage supply input connected to said positive voltage source and a first output;

a negative voltage source;

a second switching element having a second control input, a second voltage supply input connected to said negative voltage source and a second output;

a neutral voltage source;

a third switching element having a third control input, a third voltage supply input connected to said neutral voltage source and a third output;

said first, said second and said third output connected to provide a single output for connection to said piezoelectric sidewall actuator of said ink jet printhead;

said first switching element further comprising means for generating a positive voltage pulse at said single output in response to an assertion of said first control input while said second control input and said third control input are deasserted;

said second switching element further comprising means for generating a negative voltage pulse at said single output in response to a simultaneous deassertion of said first control input and assertion of said second control input while said third control input is deasserted;

said third switching element further comprising means for providing a path to ground potential at said single output in response to a simultaneous deassertion of said second control input and assertion of said third control input while said first control input is deasserted;

wherein, from a rest position, said sidewall actuator is displaced, in a first direction, to a first position by said assertion of said first control input while said second control input and said third control input are deasserted; from said first position, said sidewall actuator is displaced, in a second direction, past said rest position and to a second position by said simultaneous deassertion of said first control input and assertion of said second control input while said third control input is deasserted; and, from said second position, said sidewall actuator is displaced to said rest position by said simultaneous deassertion of said second control input and assertion of said third control input while said first control input is deasserted.

5. An ink jet printhead, comprising:

a body having a front end section with a plurality of enclosed ink receiving channels, each of said channels each longitudinally extending rearwardly through the interior of said body and opening outwardly at said front end section, a portion of each of said channels being bounded by first and second piezoelectrically deflectable actuation portions of said body; and drive means for actuating selected ones of said actuation portions, said drive means including:

a positive voltage source;

a series of first switching elements, each of said first switching elements having a first control input, a first voltage supply input connected to said positive voltage source and a first output connected to one of said actuation portions;

a negative voltage source;

a corresponding series of second switching elements, each of said second switching elements having a second control input, a second voltage supply input connected to said negative voltage source and a second output connected to said first output;

a neutral voltage source;

a corresponding series of third switching elements, each of said third switching elements having a third control input, a third voltage supply input connected to said neutral voltage source and a third output connected to said first and second output;

each of said first switching elements further including means for generating a positive voltage pulse at said first output in response to an assertion of said first control input while said second control input and said third control input are deasserted;

each of said second switching elements further including means for generating a negative voltage pulse at said second output in response to a simultaneous deassertion of said first control input and assertion of said second control input while said third control input is deasserted;

each of said third switching elements further including means for providing a path to ground potential at said third output in response to a simultaneous deassertion of said second control input and assertion of said third control input while said first control input is deasserted;

wherein, from a rest position, a selected one of said actuation portions may be deflected into a first position by said assertion of said first control input electrically associated therewith while said second control input and said third control input electrically associated therewith are deasserted, thereby imparting a compressive pressure pulse into a first channel bounded by said selected actuation portion and an expansive pressure pulse into a second channel bounded by said selected actuation portion;

from said first position, said selected actuation portion may be deflected, in a second direction, past said rest position and to a second position by said simultaneous deassertion of said first control input and assertion of said second control input electrically associated therewith while said third control input electrically associated therewith remains deasserted, thereby imparting an expansive pressure pulse into said first channel and a compressive pressure pulse into said second channel; and from said second position, said selected actuation portion may be deflected, in said first direction, back to said rest position by said simultaneous deassertion of said second control input and assertion of said third control input electrically associated therewith while said first control input electrically associated therewith remains deasserted, thereby terminating said expansive pressure pulse into said first channel and said compressive pressure pulse into said second channel.

6. A digital driver for selectively applying voltage to a piezoelectric sidewall actuator bounding a first channel and a second channel of an ink jet printhead to cause a selective deflection of said actuator to impart pressure pulses into said first channel and said second channel of said ink jet printhead, comprising:

a first voltage source having a first output voltage;

a first switching element having a first control input, a first voltage supply input connected to said first voltage source to receive said first output voltage, and a first output;

a second voltage source having a second output voltage;

a second switching element having a second control input, a second voltage supply input connected to said second voltage source to receive said second output voltage, and a second output;

a third voltage source having a third output voltage;

a third switching element having a third control input, a third voltage supply input connected to said third voltage source to receive said third output voltage, and a third output;

said first, said second and said third output connected to provide a single output for connection to said piezoelectric sidewall actuator of said ink jet printhead;

said first switching element providing said first output voltage at said single output in response to an assertion of said first control input while said second control input and said third control input are deasserted;

said second switching element providing said second output voltage at said single output in response to a simultaneous deassertion of said first control input and assertion of said second control input while said third control input is deasserted; and said third switching element providing said third output voltage at said single output in response to a simultaneous deassertion of said second control input and assertion of said third control input while said first control input is deasserted.

7. A digital driver according to claim 6 wherein said first output voltage is a positive voltage and wherein said first switching element provides said positive voltage at said single output in response to said assertion of said first control input while said second control input and said third control input are deasserted.

8. A digital driver according to claim 7 wherein said second output voltage is a negative voltage and wherein said second switching element provides said negative voltage at said single output in response to said simultaneous deassertion of said first control input and assertion of said second control input while said third control input is deasserted.

9. A digital driver according to claim 8 wherein said third output voltage is a neutral voltage and wherein said third switching element provides a path to ground potential at said single output in response to said simultaneous deassertion of said second control input and assertion of said third control input while said first control input is deasserted.

* * * * *